US006832947B2

(12) United States Patent
Manning

(10) Patent No.: US 6,832,947 B2
(45) Date of Patent: Dec. 21, 2004

(54) CMP PAD WITH COMPOSITE TRANSPARENT WINDOW

(75) Inventor: Monis J. Manning, Lexington, MA (US)

(73) Assignee: Cabot Microelectronics Corporation, Aurora, IL (US)

( * ) Notice: Subject to any disclaimer, the term of this patent is extended or adjusted under 35 U.S.C. 154(b) by 0 days.

(21) Appl. No.: 10/361,720

(22) Filed: Feb. 10, 2003

(65) Prior Publication Data

US 2004/0157534 A1 Aug. 12, 2004

(51) Int. Cl.[7] ..... B24B 1/00

(52) U.S. Cl. ..... 451/41; 451/6; 451/8; 451/9; 451/64; 451/286; 451/287; 451/288; 451/524; 451/921

(58) Field of Search ..... 451/6, 8, 9, 64, 451/286, 287, 288, 526, 521

(56) References Cited

U.S. PATENT DOCUMENTS 5,433,651 A 7/1995 Lustig et al.
5,605,760 A 2/1997 Roberts
5,893,796 A 4/1999 Birang et al.
5,964,643 A 10/1999 Birang et al.
6,146,242 A 11/2000 Treur et al.
6,171,181 B1 1/2001 Roberts et al.
6,387,312 B1 5/2002 Roberts et al.
6,604,985 B2 * 8/2003 Muilenburg et al. ..... 451/6
6,641,471 B1 * 11/2003 Pinheiro et al. ..... 451/526
2001/0031610 A1 10/2001 Budinger et al.
2001/0053658 A1 12/2001 Budinger et al.
2002/0072296 A1 6/2002 Muilenburg et al.
2002/0077037 A1 6/2002 Tietz

* cited by examiner

*Primary Examiner*—Joseph J. Hail, III
*Assistant Examiner*—Shantese McDonald

(57) ABSTRACT

The invention is directed to chemical-mechanical polishing pads comprising a transparent window comprising a polymer resin having a first index of refraction and an inorganic material having a second index of refraction. The transparent window has a light transmittance of about 10% or more at a wavelength of about 200 nm to about 10,000 nm. The difference between the first index of refraction and the second index of refraction is about 0.3 or less at the wavelength.

17 Claims, No Drawings

CM P PAD WITH COMPOSITE TRANSPARENT WINDOW

FIELD OF THE INVENTION

This invention pertains to a polishing pad comprising a composite window material for use with in situ chemical-mechanical polishing detection methods.

BACKGROUND OF THE INVENTION

Chemical-mechanical polishing ("CMP") processes are used in the manufacturing of microelectronic devices to form flat surfaces on semiconductor wafers, field emission displays, and many other microelectronic substrates. For example, the manufacture of semiconductor devices generally involves the formation of various process layers, selective removal or patterning of portions of those layers, and deposition of yet additional process layers above the surface of a semiconducting substrate to form a semiconductor wafer. The process layers can include, by way of example, insulation layers, gate oxide layers, conductive layers, and layers of metal or glass, etc. It is generally desirable in certain steps of the wafer process that the uppermost surface of the process layers be planar, i.e., flat, for the deposition of subsequent layers. CMP is used to planarize process layers wherein a deposited material, such as a conductive or insulating material, is polished to planarize the wafer for subsequent process steps.

In a typical CMP process, a wafer is mounted upside down on a carrier in a CMP tool. A force pushes the carrier and the wafer downward toward a polishing pad. The carrier and the wafer are rotated above the rotating polishing pad on the CMP tool's polishing table. A polishing composition (also referred to as a polishing slurry) generally is introduced between the rotating wafer and the rotating polishing pad during the polishing process. The polishing composition typically contains a chemical that interacts with or dissolves portions of the uppermost wafer layer(s) and an abrasive material that physically removes portions of the layer(s). The wafer and the polishing pad can be rotated in the same direction or in opposite directions, whichever is desirable for the particular polishing process being carried out. The carrier also can oscillate across the polishing pad on the polishing table.

In polishing the surface of a wafer, it is often advantageous to monitor the polishing process in situ. One method of monitoring the polishing process in situ involves the use of a polishing pad having an aperture or window. The aperture or window provides a portal through which light can pass to allow the inspection of the wafer surface during the polishing process. Polishing pads having apertures and windows are known and have been used to polish substrates, such as the surface of semiconductor devices. For example, U.S. Pat. No. 5,605,760 discloses a pad having a transparent window formed from a solid, uniform polymer, which has no intrinsic ability to absorb or transport slurry. U.S. Pat. No. 5,433,651 discloses a polishing pad wherein a portion of the pad has been removed to provide an aperture through which light can pass. U.S. Pat. Nos. 5,893,796 and 5,964,643 disclose removing a portion of a polishing pad to provide an aperture and placing a transparent polyurethane or quartz plug in the aperture to provide a transparent window, or removing a portion of the backing of a polishing pad to provide a translucency in the pad. U.S. Pat. Nos. 6,171,181 and 6,387,312 disclose a polishing pad having a transparent region that is formed by solidifying a flowable material (e.g., polyurethane) at a rapid rate of cooling.

Only a few materials have been disclosed as useful for polishing pad windows. U.S. Pat. No. 5,605,760 discloses the use of a solid piece of polyurethane. U.S. Pat. Nos. 5,893,796 and 5,964,643 disclose the use of either a polyurethane plug or a quartz insert. U.S. Pat. No. 6,146,242 discloses a polishing pad with a window comprising either polyurethane or a clear plastic such as Clariflex™ tetrafluoroethylene-co-hexafluoropropylene-co-vinylidene fluoride terpolymer sold by Westlake. Polishing pad windows made of a solid polyurethane are easily scratched during chemical-mechanical polishing, resulting in a steady decrease of the optical transmittance during the lifetime of the polishing pad. This is particularly disadvantageous because the settings on the endpoint detection system must be constantly adjusted to compensate for the loss in optical transmittance. In addition, pad windows, such as solid polyurethane windows, typically have a slower wear rate than the remainder of the polishing pad, resulting in the formation of a "lump" in the polishing pad, which leads to undesirable polishing defects. To address some of these problems, WO 01/683222 discloses a window having a discontinuity that increases the wear rate of the window during CMP. The discontinuity purportedly is generated in the window material by incorporating into the window either a blend of two immiscible polymers or a dispersion of solid, liquid, or gas particles.

While many of the known window materials are suitable for their intended use, there remains a need for effective polishing pads having translucent regions that can be produced using efficient and inexpensive methods and provide constant light transmissivity over the lifetime of the polishing pad. The invention provides such a polishing pad, as well as methods of its use. These and other advantages of the present invention, as well as additional inventive features, will be apparent from the description of the invention provided herein.

BRIEF SUMMARY OF THE INVENTION

The invention provides a polishing pad for chemical-mechanical polishing comprising a transparent window. The transparent window has a total light transmittance of about 10% or more at a wavelength in the range of about 200 nm to about 10,000 nm. The transparent window comprises a polymer resin having a first index of refraction at a particular wavelength and an inorganic material having a second index of refraction at the same wavelength. The difference between the first and second indices of refraction (i.e., the difference when measured using the same wavelength of light) desirably is about 0.3 or less. The invention further provides a chemical-mechanical polishing apparatus and a method of polishing a workpiece. The CMP apparatus comprises (a) a platen that rotates, (b) a polishing pad of the invention, and (c) a carrier that holds a workpiece to be polished by contacting the rotating polishing pad. The method of polishing comprises the steps of (i) providing a polishing pad of the invention, (ii) contacting a workpiece with the polishing pad, and (iii) moving the polishing pad relative to the workpiece to abrade the workpiece and thereby polish the workpiece.

DETAILED DESCRIPTION OF THE INVENTION

The invention is directed to a polishing pad for chemical-mechanical polishing comprising a transparent window, wherein the transparent window comprises a polymer resin and an inorganic material. The transparent window can be a portion within a polishing pad, or the transparent window can be the entire polishing pad (e.g., the entire polishing pad or polishing top pad is substantially transparent and comprises a polymer resin and an inorganic material).

The transparent window of the invention is intended for use in monitoring the progress of a polishing process over time using an endpoint detection system. In an endpoint detection system, a beam of light is passed through the transparent window of a polishing pad and onto the surface of a workpiece being polished. It is important that the beam of light passes through the transparent window without being excessively scattered and with a substantially consistent gain so that the endpoint detection system has good signal to noise over the entire polishing process.

To be useful for endpoint detection, it is desirable that the transparent window has a total light transmittance of about 10% or more (e.g., about 20% or more, or even about 30% or more) at a wavelength in the range of about 200 nm to about 10,000 nm (e.g., about 200 nm to about 5,000 nm, or even about 200 nm to about 2,000 nm). This means that there is at least one wavelength of light within the stated range for which the transparent window of the invention has a total light transmittance of about 10% or more (e.g., about 20% or more, or even about 30% or more). There can be more than one wavelength, or even a range of wavelengths, for which the transparent window of the invention has a total light transmittance of about 10% or more (e.g., about 20% or more, or even about 30% or more). Preferably, the transparent window has a total light transmittance of about 10% or more (e.g., about 20% or more, or even about 30% or more) at a wavelength in the range of about 200 nm to about 1000 nm (e.g., about 200 nm to about 800 nm). In some embodiments, the window has a total light transmittance of about 90% or less (e.g., about 80% or less, or even about 70% or less) at one or more wavelengths in the range of about 200 nm to about 10,000 nm (e.g., about 200 nm to about 5,000, or even about 200 nm to about 1000 nm).

In the transparent window of the invention, the inorganic material dispersed within the polymer matrix can absorb and/or scatter the incident light and thus reduce the amount of light that reaches the surface of the workpiece. The factors determining the extent of light scattering and absorption in a composite polymer/inorganic material are complex and include the particle size of the inorganic material, the concentration of the inorganic material in the polymer matrix, and the degree of refractive index matching between the polymer material and the inorganic material. Generally, for particles of a size much smaller than the wavelength of light, the degree of refractive index matching is less important at long wavelengths of light, for example light having a wavelength of about 5,000 nm to about 10,000 nm, while the degree of index matching is more important at short wavelengths of light, for example light having a wavelength of about 200 nm to about 1,000 nm. Accordingly, the difference between the index of refraction of the polymer resin and the index of refraction of the inorganic material depends on the wavelength of light being used in the endpoint detection system. Typically, it is desirable for the difference to be about 0.3 or less at the wavelength of the incident light. When the wavelength is about 5,000 nm to about 10,000, a refractive index difference of about 0.3 or less (e.g., about 0.2 to about 0.3) at the wavelength of the incident light is desired. When the wavelength is about 1,000 nm to about 5,000 nm, it is desirable that the refractive index difference be about 0.2 or less (e.g., about 0.1 to about 0.2) at the wavelength of the incident light. When the wavelength is about 200 nm, to about 1,000 nm, the refractive index difference desirably is about 0.1 or less (e.g., about 0.05 or less, or even about 0.02 or less) at the wavelength of the incident light.

As noted above, the amount of light scattering resulting from the disparity between the refractive indices also depends on the relationship between the particle size of the inorganic material and the wavelength of the light. Thus, when the particle size is much smaller than (e.g., at least 100 nm less than, or at least about 500 nm less than) the wavelength of the light, the difference between the refractive indices of the inorganic material and the polymer resin can be relatively large (e.g., about 0.05 or more, or about 0.1 or more). Thus, at very small particle sizes, the degree of index matching required is less critical, and a notable difference in refractive indices can be tolerated without substantial loss of light signal. However, when the particle size is approximately equal to (e.g., the particle size is within about ±100 nm of the wavelength of the light) or is larger than (e.g., about 100 nm greater than, or about 500 nm greater than) the wavelength of the light, the difference between the refractive indices of the inorganic material and the polymer resin becomes more important since the light scattering by the inorganic material becomes more efficient. In these situations, the difference between the refractive indices of the polymer resin and the inorganic material desirably is less than about 0.05 (e.g., about 0.04 or less, about 0.03 or less, or even about 0.02 or less). See van de Hulst in "Light Scattering by Small Particles" (Dover Publications, New York, 1981) for a discussion of light scattering and the principles governing the relationship between particle size, wavelength, and refractive index matching.

The polymer resin can be any suitable polymer resin. For example, the polymer resin can be selected from the group consisting of thermoplastic elastomers, thermoplastic polyurethanes, thermoplastic polyolefins, polycycloolefins, polycarbonates, polyvinylalcohols, nylons, elastomeric rubbers, elastomeric polyethylenes, polytetrafluoroethylene, polyethyleneteraphthalate, polyimides, polyaramides, polyarylenes, polystyrenes, polymethylmethacrylates, copolymers thereof and mixtures thereof. Preferably, the polymer resin is a thermoplastic polyolefin or polycycloolefin. More preferably, the polycycloolefin is a copolymer of norbornene and a monomer selected from the group consisting of cyclopentadiene, ethylene, and combinations thereof.

The inorganic material can be any suitable inorganic material. For example, the inorganic material can comprise a metal oxide (e.g., silica, alumina, and ceria), silicon carbide, glass, diamond, or a phyllosilicate material such as mica and clays, such as montmorillonite, kaolinite, and talc. Preferably, the inorganic material comprises glass, in particular soda lime glass. When the inorganic material is glass, it may be desirable to use a silane coating to improve adhesion of the glass to the polymer matrix.

The inorganic material can be distributed through the polymer resin by any suitable method and in any suitable pattern. For example, the inorganic material can be dispersed throughout the polymer resin, across a surface (e.g., a surface that is contacted with a substrate during polishing, i.e., a "polishing surface") of the polymer resin, or a combination thereof. Preferably, the inorganic material is uniformly dispersed throughout the polymer resin. Desirably, the transparent window is substantially solid, i.e., contains little or no pores (e.g., air bubbles). If present, it is preferred that the pores have an average diameter that is less than about 1 micron.

The inorganic material can have any suitable shape or dimensions. Preferably, the inorganic material is in the form of spherical or nearly spherical particles having an average particle size (e.g., diameter) of about 20 microns or less (e.g., about 15 microns or less, or about 10 microns or less). More preferably, the inorganic material has a dimension of about 5 microns or less (e.g., about 2 microns or less, or about 1 micron or less). The preferred particle size of the inorganic material will depend in part on the wavelength of light being used and the refractive index of the polymer resin, as discussed above.

The inorganic material typically is present in the transparent window in an amount of about 1 wt. % or more (e.g., about 3 wt. % or more, about 5 wt.% or more, or even about 8 wt. % or more) of the transparent window based on the total weight of the transparent window. Preferably, the inorganic material comprises about 40 wt. % or less (e.g., about 30 wt. % or less, or about 20 wt. % or less) of the transparent window based on the total weight of the polymer resin and the inorganic material. The preferred amount of the inorganic material present in the transparent window will depend on the wavelength of the light, the particle size of the inorganic material, and the degree of index matching between the inorganic material and the polymer resin.

The transparent window can be produced by any suitable technique, many of which are known in the art. For example, the transparent window can be produced by extrusion, injection molding, sintering, or the like. Preferably, the transparent window is produced by extrusion. The transparent window typically has a thickness of about 3 mm or more. Preferably, the transparent window has a thickness of about 4 mm to about 7 mm, more preferably about 5 mm to about 6 mm.

The transparent window of the invention offers improved consistency of the light transmittance over the lifetime of the transparent window. This feature arises from the fact that the inorganic material is present throughout the thickness of the transparent window. Thus, when the surface layer is removed during polishing, the subsequent layers beneath the surface have substantially similar roughness, and thus have substantially similar polishing properties and light transmittance properties to the top surface layer. In addition, the transmissivity of the transparent window is on average lower than the same material without the inorganic material which leads to light scattering, and so the percentage change in light scattering due to any change resulting from abrasion of the transparent window during polishing is also lessened. Desirably, the total light transmittance of the transparent window decreases by about 10% or less (e.g., about 5% or less, or even about 2% or less) over the lifetime of the transparent window. These changes, taken together, will lessen or even obviate the need to adjust the gain of the endpoint detection system over the lifetime of the transparent window. Desirably, the consistency in light transmittance of the transparent window of the invention favorably compares to a solid, or nearly solid, polyurethane window of the prior art. Before polishing, solid polyurethane windows have consistent surface properties; however, during polishing the window becomes abraded and scratched giving rise to inconsistent surface properties. Therefore, an endpoint detection system must be constantly adjusted in response to each new pattern of scratches that arises during polishing. Contrastingly, the transparent window of the invention begins with a roughened surface that remains substantially unchanged during and after abrasion during polishing such that the endpoint detection settings can remain substantially unchanged over the lifetime of the transparent window.

The transparent window of the invention optionally further comprises a dye (or pigment), which enables the substrate to selectively transmit light of a particular wavelength (s). The dye acts to filter out undesired wavelengths of light (e.g., background light) and thus improve the signal to noise ratio of detection. The transparent window can comprise any suitable dye or may comprise a combination of dyes. Suitable dyes include polymethine dyes, di-and tri-arylmethine dyes, aza analogues of diarylmethine dyes, aza (18) annulene dyes, natural dyes, nitro dyes, nitroso dyes, azo dyes, anthraquinone dyes, sulfur dyes, and the like. Desirably, the transmission spectrum of the dye matches or overlaps with the wavelength of light used for in situ endpoint detection. For example, when the light source for the endpoint detection (EPD) system is a HeNe laser, which produces visible light having a wavelength of about 633 nm, the dye preferably is a red dye, which is capable of transmitting light having a wavelength of about 633 nm.

When the transparent window of any of the embodiments of the inventive polishing pad constitutes only a portion of the polishing pad, the window can be mounted into the polishing pad using any suitable technique. For example, the window can be mounted into the polishing pad through the use of adhesives. The window can be mounted into the top portion of the polishing pad (e.g., the polishing surface), or can be mounted into the bottom portion of the polishing pad (e.g., the subpad). The transparent window can have any suitable dimensions and can be round, oval, square, rectangular, triangular, and so on. The transparent window can be positioned so as to be flush with the polishing surface of the polishing pad, or can be recessed from the polishing surface of the polishing pad. The polishing pad can comprise one or more of the transparent windows of the invention. The transparent window(s) can be placed in any suitable position on the polishing pad relative to the center and/or periphery of the polishing pad.

The polishing pad into which the transparent window is placed can be made of any suitable polishing pad material, many of which are known in the art. The polishing pad typically is opaque or only partially translucent. The polishing pad can comprise any suitable polymer resin. For example, the polishing pad typically comprises a polymer resin selected from the group consisting of thermoplastic elastomers, thermoplastic polyurethanes, thermoplastic polyolefins, polycarbonates, polyvinylalcohols, nylons, elastomeric rubbers, elastomeric polyethylenes, polytetrafluoroethylene, polyethyleneteraphthalate, polyimides, polyaramides, polyarylenes, polystyrenes, polymethylmethacrylates, copolymers thereof, and mixtures thereof. The polishing pad can be produced by any suitable method including sintering, injection molding, blow molding, extrusion, and the like. The polishing pad can be solid and non-porous, can contain microporous closed cells, can contain open cells, or can contain a fibrous web onto which a polymer has been molded.

The polishing pad of the invention has a polishing surface which optionally further comprises grooves, channels, and/or perforations which facilitate the lateral transport of polishing compositions across the surface of the polishing pad. Such grooves, channels, or perforations can be in any suitable pattern and can have any suitable depth and width. The polishing pad can have two or more different groove patterns, for example a combination of large grooves and small grooves as described in U.S. Pat. No. 5,489,233. The grooves can be in the form of slanted grooves, concentric grooves, spiral or circular grooves, XY cross-hatch pattern, and can be continuous or non-continuous in connectivity. Preferably, the polishing pad comprises at least small grooves produced by standard pad conditioning methods.

The polishing pad of the invention can comprise, in addition to the transparent window, one or more other features or components. For example, the polishing pad optionally can comprise regions of differing density, hardness, porosity, and chemical compositions. The polishing pad optionally can comprise solid particles including abrasive particles (e.g., metal oxide particles), polymer particles, water-soluble particles, water-absorbent particles, hollow particles, and the like.

The polishing pad of the invention is particularly suited for use in conjunction with a chemical-mechanical polishing (CMP) apparatus. Typically, the apparatus comprises a platen, which, when in use, is in motion and has a velocity that results from orbital, linear, or circular motion, a polishing pad of the invention in contact with the platen and moving with the platen when in motion, and a carrier that holds a workpiece to be polished by contacting and moving relative to the surface of the polishing pad. The CMP apparatus can be any suitable CMP apparatus, many of which are known in the art. The polishing pad of the invention also can be used with linear polishing tools.

The polishing of the workpiece takes place by the workpiece being placed in contact with the polishing pad and then the polishing pad moving relative to the workpiece, typically with a polishing composition therebetween, so as to abrade at least a portion of the workpiece to polish the workpiece. The polishing composition typically comprises a liquid carrier (e.g., an aqueous carrier), a pH adjustor, and optionally an abrasive. Depending on the type of workpiece being polished, the polishing composition optionally may further comprise oxidizing agents, organic acids, complexing agents, pH buffers, surfactants, corrosion inhibitors, antifoaming agents, and the like.

Desirably, the CMP apparatus further comprises an in situ polishing endpoint detection system, many of which are known in the art. Techniques for inspecting and monitoring the polishing process by analyzing light or other radiation reflected from a surface of the workpiece are known in the art. Such methods are described, for example, in U.S. Pat. Nos. 5,196,353, 5,433,651, 5,609,511, 5,643,046, 5,658,183, 5,730,642, 5,838,447, 5,872,633, 5,893,796, 5,949,927, and 5,964,643. Desirably, the inspection or monitoring of the progress of the polishing process with respect to a workpiece being polished enables the determination of the polishing end-point, i.e., the determination of when to terminate the polishing process with respect to a particular workpiece.

The polishing pad described herein can be used alone or optionally can be used as one layer of a multi-layer stacked polishing pad. For example, the polishing pad can be used in combination with a subpad. The subpad can be any suitable subpad. Suitable subpads include polyurethane foam subpads (e.g., Poron® foam subpads from Rogers Corporation), impregnated felt subpads, microporous polyurethane subpads, or sintered urethane subpads. The subpad typically is softer than the polishing pad of the invention and therefore is more compressible and has a lower Shore hardness value than the polishing pad of the invention. For example, the subpad can have a Shore A hardness of about 35 to about 50. In some embodiments, the subpad is harder, is less compressible, and has a higher Shore hardness than the polishing pad. The subpad optionally comprises grooves, channels, hollow sections, windows, apertures, and the like. When the polishing pad of the invention is used in combination with a subpad, typically there is an intermediate backing layer such as a polyethyleneterephthalate adhesive film, coextensive with and between the polishing pad and the subpad.

The polishing pad of the invention is suitable for use in polishing many types of workpieces (e.g., substrates or wafers) and workpiece materials. For example, the polishing pad can be used to polish workpieces including memory storage devices, semiconductor substrates, and glass substrates. Suitable workpieces for polishing with the polishing pad include memory or rigid disks, magnetic heads, MEMS devices, semiconductor wafers, field emission displays, and other microelectronic substrates, especially microelectronic substrates comprising insulating layers (e.g., silicon dioxide, silicon nitride, or low dielectric materials) and/or metal-containing layers (e.g., copper, tantalum, tungsten, aluminum, nickel, titanium, platinum, ruthenium, rhodium, iridium or other noble metals).

EXAMPLE

This example illustrates the transparency of a composite window useful in the polishing pad of the invention. The transparent window comprises a polycycloolefin and glass.

Molded glass/polymer composite windows (Samples 1A–1O) were prepared by extrusion using silane coated soda lime glass spheres having a particle size of less than 20 microns (80% having a particle size of less than 15 microns) and a polycycloolefin polymer. The silane-coated soda lime glass has a refractive index of 1.51, and the polycycloolefin has a refractive index of 1.53 (difference of 0.02 units). The amount of the glass incorporated into the polycycloolefin matrix was 11.5 wt. % for each composite window. The optical transmittance (both total transmittance and specular transmittance) was determined for each of the composite window samples. The total light transmittance for each of the composite window samples was on average about 40%. The specular component of the light transmittance (i.e., central component of the transmitted beam) and the window thickness for each composite window sample are given in the table below.

| Composite | Thickness (mm) | % Specular Transmittance |
|---|---|---|
| A | 5.85 | 7.37 |
| B | 6.50 | 5.81 |
| C | 6.00 | 7.39 |
| D | 6.35 | 6.15 |
| E | 6.40 | 5.51 |
| F | 5.90 | 7.55 |
| G | 6.00 | 7.72 |
| H | 5.85 | 7.5 |
| I | 5.95 | 7.95 |
| J | 6.10 | 7.5 |
| K | 6.15 | 7.99 |
| L | 6.20 | 7.78 |
| M | 6.10 | 7.84 |
| N | 6.15 | 8.05 |
| O | 6.15 | 8.89 |
| Average | 6.10 | 7.40 |

The data in the table show that composite windows comprising polymeric materials and inorganic particles can have sufficient light transmittance to be suitable for use in a polishing pad with an endpoint detection system.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A polishing pad for chemical-mechanical polishing comprising a transparent window portion that has a total light transmittance of about 10% or more at a wavelength of about 200 nm to about 10,000 nm, wherein the transparent window portion comprises a polymer resin having a first index of refraction at the wavelength and an inorganic material having a second index of refraction at the wavelength, and wherein the difference between the first and second indices of refraction is about 0.3 or less.

2. The polishing pad of claim 1, wherein difference between the first and second indices of refraction is about 0.2 or less and the wavelength of light is about 1,000 to about 5,000 nm.

3. The polishing pad of claim 1, wherein difference between the first and second indices of refraction is about 0.1 or less and the wavelength of light is about 200 nm to about 1,000 nm.

4. The polishing pad of claim 3, wherein the difference between the first and second indices of refraction is about 0.05 or less and the wavelength of light is about 200 nm to about 1,000 nm.

5. The polishing pad of claim 1, wherein the polymer resin comprises a polycycloolefin.

6. The polishing pad of claim 5, wherein the polycycloolefin is copolymer of norbornene and a monomer selected from cyclopentadiene, ethylene, and combinations thereof.

7. The polishing pad of claim 1, wherein the inorganic material is glass.

8. The polishing pad of claim 7, wherein the glass is coated with a silane.

9. The polishing pad of claim 7, wherein the glass is in the form of microspheres having an average diameter of about 20 microns or less.

10. The polishing pad of claim 9, wherein the glass microspheres have an average diameter of about 1 micron or less.

11. The polishing pad of claim 1, wherein the transparent window portion comprises about 5 wt. % to about 40 wt. % inorganic material, based on the total weight of the polymer resin and the inorganic material.

12. The polishing pad of claim 1, wherein the transparent window portion has a total light transmittance of about 10% or more at a wavelength of about 200 nm to about 1,000 nm.

13. The polishing pad of claim 1, wherein the inorganic material is dispersed throughout the polymer resin.

14. The polishing pad of claim 1, wherein the inorganic material is dispersed across a surface of the polymer resin.

15. A chemical-mechanical polishing apparatus comprising:

(a) a platen that rotates, (b) a polishing pad comprising a transparent window portion that has a total light transmittance of about 10% or more at a wavelength of about 200 nm to about 10,000 nm, wherein the transparent window portion comprises a polymer resin having a first index of refraction at the wavelength and an inorganic material having a second index of refraction at the wavelength, and wherein the difference between the first and second indices of refraction is about 0.3 or less, and (c) a carrier that holds a workpiece to be polished by contacting the rotating polishing pad.

16. The chemical-mechanical polishing apparatus of claim 15, further comprising an in situ polishing endpoint detection system.

17. A method of polishing a workpiece comprising (i) providing a polishing pad comprising a transparent window portion that has a total light transmittance of about 10% or more at a wavelength of about 200 nm to about 10,000 nm, wherein the transparent window portion comprises a polymer resin having a first index of refraction at the wavelength and an inorganic material having a second index of refraction at the wavelength, and wherein the difference between the first and second indices of refraction is about 0.3 or less, (ii) contacting a workpiece with the polishing pad, and (iii) moving the polishing pad relative to the workpiece to abrade the workpiece and thereby polish the workpiece.

* * * * *